US010092475B2

(12) United States Patent
Smith

(10) Patent No.: US 10,092,475 B2
(45) Date of Patent: Oct. 9, 2018

(54) COMBINATION CRUTCH AND KNEE WALKER DEVICE

(71) Applicant: Philip Smith, Monterey Park, CA (US)

(72) Inventor: Philip Smith, Monterey Park, CA (US)

( * ) Notice: Subject to any disclaimer, the term of this patent is extended or adjusted under 35 U.S.C. 154(b) by 0 days.

(21) Appl. No.: 15/484,075

(22) Filed: Apr. 10, 2017

(65) Prior Publication Data

US 2017/0290730 A1 Oct. 12, 2017

Related U.S. Application Data

(60) Provisional application No. 62/320,345, filed on Apr. 8, 2016.

(51) Int. Cl.

| | |
|---|---|
| ***A61H 3/04*** | (2006.01) |
| ***A61H 3/02*** | (2006.01) |
| *A61H 3/00* | (2006.01) |

(52) U.S. Cl.

CPC ..... *A61H 3/04* (2013.01); *A61H 3/0288* (2013.01); *A61H 2003/002* (2013.01); *A61H 2003/005* (2013.01); *A61H 2003/046* (2013.01); *A61H 2201/0192* (2013.01); *A61H 2201/1635* (2013.01)

(58) Field of Classification Search

CPC ..... A61H 3/0288; A61H 3/04; A61H 2201/1635; A61H 2003/046; A61H 2003/002; A61H 2003/005; A61H 2201/0192

See application file for complete search history.

(56) References Cited

U.S. PATENT DOCUMENTS

| | | | | | |
|---|---|---|---|---|---|
| 2,678,054 | A * | 5/1954 | Bostelman | A61H 3/02 | 135/68 |
| 4,029,311 | A * | 6/1977 | Chanslor | A61H 3/04 | 188/29 |
| 4,226,413 | A * | 10/1980 | Daugherty | A61H 3/04 | 188/1.12 |
| 4,291,715 | A * | 9/1981 | Monte | A61H 3/02 | 135/68 |
| 4,341,381 | A * | 7/1982 | Norberg | A61H 3/04 | 135/67 |
| 5,746,236 | A * | 5/1998 | Tilsley | A61H 3/02 | 135/66 |
| 2004/0216776 | A1* | 11/2004 | Otis | A45B 1/02 | 135/85 |

(Continued)

*Primary Examiner* — Frank B Vanaman
(74) *Attorney, Agent, or Firm* — Elizabeth Yang

(57) ABSTRACT

A combination crutch and knee walker device converts between a rolling knee walker configuration and a crutch configuration through a single folding or expanding articulation that requires no tools or skillset. The device includes a first support bar that forms the primary lever of support. A second support bar pivotally joins the first support bar at a hinged junction, generally three-quarters down from the top of the first support bar. The support bars fold and expand about the hinged junction to convert between crutch and knee walker. A panel hingedly joins at the hinged junction serving as a supportive platform for an upper body, such as the arm or the knee, depending on the crutch or knee walker configuration. Further, the mobility function, such as rolling rollers, will restrict or free rotation depending on the selected configuration of the device.

18 Claims, 8 Drawing Sheets

(56) References Cited

U.S. PATENT DOCUMENTS

| | | | | |
|---|---|---|---|---|
| 2008/0174084 | A1* | 7/2008 | Gee | A61H 3/04 280/200 |
| 2012/0047648 | A1* | 3/2012 | Purwar | A61G 7/1017 5/86.1 |
| 2012/0090926 | A1* | 4/2012 | Dunlap | A61H 3/04 188/68 |
| 2014/0261588 | A1* | 9/2014 | LaFord | A61H 3/02 135/66 |
| 2016/0058648 | A1* | 3/2016 | Soulakis | A61H 3/02 135/68 |

* cited by examiner

COMBINATION CRUTCH AND KNEE WALKER DEVICE

CROSS REFERENCE OF RELATED APPLICATIONS

This application claims the benefits of U.S. provisional application No. 62/320,345 filed Apr. 8, 2016 and entitled CONVERTIBLE SINGLE FOLDING ACTION AMBULATION ASSEMBLY, which provisional application is incorporated by reference herein in its entirety.

FIELD OF THE INVENTION

The present invention relates generally to a combination crutch and knee walker device. More so, the combination crutch and knee walker device is configured to easily convert between a knee walker and a crutch through a single folding or expanding articulation; whereby the device is defined by a first support bar having a first mobile end for mobility and a brace end for supporting the upper body of a user, a second support bar disposed to cross the first support bar at a hinged junction, the second support bar defined by a second mobile end for mobility and a panel end having a panel for supporting the knee or arm of the user depending on the selection of knee walker or crutch; whereby pivotally articulating the second support bar into a parallel arrangement with the first support bar and the panel forms the crutch configuration; and whereby pivotally articulating the second support bar into a crossing arrangement with the first support bar and the panel forms the knee walker configuration.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, crutches are an ambulation aid that can be used as a single side aid or dual side, one on each side of a patient with a leg injury. Crutches can also be used ascending or descending stairs, commonly using only one crutch while holding the handrail to be easier and safer. However, when crutches are used on rather flat surfaces, movement is rather slow compared to normal two-leg walking.

It is also known that knee walkers provide another ambulation aid that utilizes a soft lower platform for the user to place the knee. The knee walker includes front handles to hold while pushing along with the good leg, like a scooter. The knee walker can come in different types, some with steerable front wheels, some with 3 or 4 wheels, and some with carrying baskets.

However, these knee crutches are relatively heavy compared to a common crutch and are problematic to use on stairs, working only on flat surfaces. Knee crutches usually have a hand brake which can be set to hold the unit from rolling then stopped or to slow down the unit while traveling. Thus, it can be advantageous to convert between a crutch and a knee walker with minimal effort or skillset.

Other proposals have involved crutches and knee walker combination devices. The problem with these ambulation devices is that they do not allow the user to conveniently switch between a crutch and a knee walker. Also, the knee walker does not have gear mechanism to restrict the wheels from rolling. Even though the above cited ambulation devices meets some of the needs of the market, a combination crutch and knee walker device that easily converts between a knee walker and a crutch through a single folding or expanding articulation is still desired.

SUMMARY

Illustrative embodiments of the disclosure are generally directed to a combination crutch and knee walker device. The combination crutch and knee walker device provides a convertible ambulation that is configured to easily convert between a knee walker and a crutch through a single folding or expanding articulation that requires no special tools or skillset. The device is effective in that a user may selectively switch between using a standard crutch or a knee walker without great assistance. This may be especially useful for a handicap or injured user of the device.

While the device is in a crutch configuration, a pair of padded first support bars rest securely under the armpit of the user while the user propels the crutch to generate leverage for propulsion, much like a simple lever. Yet, when desired, the user may simply expand the crutch into a knee walker with a single pivoting articulated motion of the first support bars and a pair of second support bars. This converts the crutch to a mobile knee walker configuration that can support the user's knee while enabling the user to ambulate across the ground surface, on a roller and wheels. The user may thus benefit from the best of both ambulation aids without strenuous or complicated procedures or tools.

In the crutch configuration, the device utilizes a minimal amount of components to operate and convert to the knee walker configuration. In one embodiment, the device comprises a first support bar. The first support bar forms the primary lever of support for ambulating the user in the crutch configuration. A second support bar pivotally joins the first support bar at a hinged junction, generally three-quarters down from the top of the first support bar. The second support bar, though disengaged from the ground surface in the crutch configuration, is substantial in the knee walker configuration.

The support bars pivotally articulate about a hinged junction to convert between the crutch configuration and the knee walker configuration. Further, the mobility function of the device, which utilizes components such as rolling roller, and wheels to move the knee walker configuration, may be selectively actuated or disengaged depending on whether the device is used as a crutch configuration or a knee walker configuration. For example, the roller and wheels are not useful or safe when rotating in the crutch configuration, and thus must be disengaged (restricted from rotating).

The device further comprises a panel that hingedly joins a panel end of the second support bar. In one embodiment, a panel axle extending between the pair of second support bars, proximal to the panel end. The panel may pivot about the panel axle.

The panel serves as a supportive platform for the arm or knee, depending on the selected ambulation aid. In the crutch configuration, the panel extends parallel to the support bars to support the length of the arm laterally. In the knee walker configuration, the panel folds in about 120° relative to the crossed support bars to support the knee, and the weight of the user. The panel may include a channel that transversely crosses the panel to receive at least one panel release pin. At least one panel release pin is displaced along the length of the channel to regulate folding of the panel.

The device, thus has the benefits of a typical knee walker through the use of rollers and rolling wheels for fast movement along a relatively flat surface. But the device also quickly folds with one swift motion to a typical crutch for lever-like ambulation on stairs or on flat surfaces where deploying a knee walker isn't convenient. In either case, the device only requires a single articulated pivoting motion to convert between the crutch and the knee walker configurations.

In one aspect, a combination crutch and knee walker device for converting between a crutch and a knee walker, comprises:

a pair of first support bars defined by a first mobile end and a brace end, the brace end forming two apertures;

at least one roller disposed at the first mobile end of the pair of support bars, the at least one roller having a plurality of teeth disposed in a radial arrangement;

a gear mechanism configured to enable selective engagement and disengagement with the plurality of teeth of the at least one roller, whereby the gear mechanism selectively restricts rotation of the at least one roller or enables free rotation of the at least one roller, the gear mechanism comprising a sliding link defined by a teeth end and a lever end, the sliding link configured to extend along the length of the first support bar;

a lever configured to operatively connect to the lever end of the sliding link, the lever further configured to enable displacement of the teeth end of the sliding link in and out of engagement with the plurality of teeth, whereby engagement of the teeth end with the plurality of teeth restricts rotation of the at least one roller, whereby disengagement of the teeth end from the plurality of teeth enables free rotation of the at least one roller;

a crossbar configured to traverse the pair of first support bars;

a pair of second support bars defined by a second mobile end and a panel end, the pair of second support bars configured to pivotally engage the pair of first support bars at a hinged junction, whereby the pair of second support bars are configured to pivotally articulate parallel to, or at an angle relative to the pair of first support bars;

a plurality of wheels disposed at the second mobile end of the pair of second support bars, the plurality of wheels configured to enable mobility of the device;

a pair of folding link bars disposed to extend between a generally central region of the pair of second support bars and the first mobile end of the pair of first support bars, the pair of folding link bars configured to help maintain structural integrity and relative positioning of the pairs of first and second support bars, the pair of folding link bars further configured to be in hinged communication with the pairs of first and second support bars;

a panel configured to hingedly join with the panel end of the pair of second support bars, the panel configured to pivotally articulate in conjunction with the pair of second support bars, the panel comprising an upper surface and a bottom surface defined by a channel, whereby a crutch configuration forms during a parallel disposition of the panel relative to the pair of first and second support bars, and a parallel disposition of the second support bar to the first support bar, whereby a knee walker configuration forms when the panels is angled relative to the pair of second support bars, and the pair of second support bars are angled relative to the pair of first support bars; and a panel release pin configured to pass through the channel in the bottom surface of the panel, the panel release pin configured to be spring loaded, whereby in a natural position the panel release pin creates an outward bias that restricts folding of the panel, whereby when an inward force is applied to the panel release pin, the panel folds freely.

In a second aspect, the brace end is configured to enable support of an upper body of a person.

In another aspect, the device is configured to form a crutch configuration when the second support bar is parallel to the first support bar and the panel.

In another aspect, the device is configured to form a knee walker configuration when the second support bar is at an angle relative to first support bar, and when the panel is about 120° relative to the second support bar.

In another aspect, the first support bar is longer than the second support bar.

In another aspect, brace end of the first support bar has a generally arced shape.

In another aspect, brace end of the first support bar comprises two apertures.

In yet another aspect, the gear mechanism is configured to selectively lock the second support bar either parallel or at an angle relative to the first support bar.

In another aspect, the gear mechanism comprises an anti-rotation locking system.

In another aspect, the teeth end of the sliding link forms an arc that is configured to slide between the plurality of teeth.

In yet another aspect, the hinged junction comprises a cross bar release clip, the cross bar release clip configured to enable height adjustment of the crossbar.

In yet another aspect, plurality of wheels comprises two spaced-apart wheels.

In another aspect, the at least one roller may include one center wheel or one dual wheel joined on each side, or not joined, or a long wheel similar to a rolling pin.

In yet another aspect, the panel is generally curved and resilient.

In yet another aspect, the first support bar and the second support bar are fabricated from a medical grade material.

One objective of the present invention is to provide a combination crutch and knee walker device that easily converts between a knee walker and a crutch through a single folding or expanding articulation that requires no special tools or skillset.

Another objective is to provide an improved crutch configuration which will enable a user to transport and use a crutch in the traditional manner or as a combination crutch and knee walker.

Another objective is to enable a user to selectively switch between using a standard crutch or a knee walker without great assistance.

Yet another objective is to provide a height adjustable pair of first support bars that have sufficient structural rigidity to serve as crutches.

Yet another objective is to provide a padded crossbar to provide greater support to the upper body of a user when in the crutch configuration.

Yet another objective is to provide a roller and a pair of wheels to enable easy rolling in the knee walker configuration.

Yet another objective is to provide a sliding link mechanism that easily and selectively restricts and frees the roller to roll along a ground surface in the knee walker configuration.

Yet another objective is to provide a padded panel for the knee to rest on while in the knee walker configuration.

Yet another objective is to provide a knee walker which affords easy adjustment and use for either a right or left leg injury Yet another objective is to provide a knee walker having a knee support which affords easy vertical adjustment for accommodation of the user's height.

Yet another objective is to provide an inexpensive to manufacture crutch and knee walker combination device.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 1A shows a knee walker, and FIG. 1B shows a crutch, in accordance with an embodiment of the present invention;

FIG. 7A illustrates an exemplary gear mechanism along a first support bar, and FIG. 7B illustrates an exemplary lever for an exemplary sliding link, in accordance with an embodiment of the present invention; FIG. 8A illustrates a bottom surface of a panel, and FIG. 8B illustrates an exemplary panel release pin, in accordance with an embodiment of the present invention.

Like reference numerals refer to like parts throughout the various views of the drawings.

DETAILED DESCRIPTION OF THE INVENTION

Figure 1A:
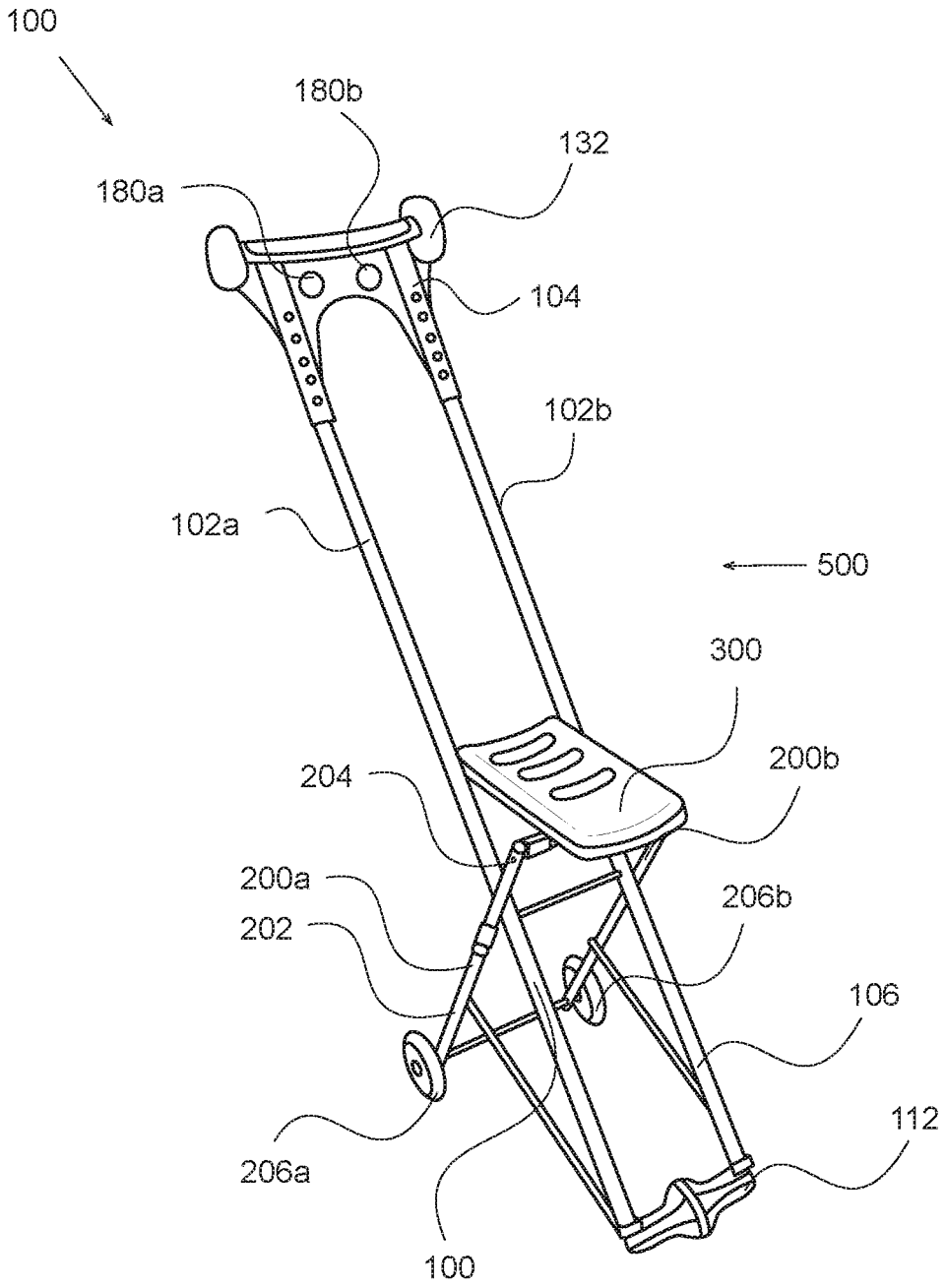
FIGS. 1A and 1B illustrate perspective views of a combination crutch and knee walker device in two possible ambulation aid configurations, where

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1A. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention presented in FIGS. 1A-8B, combination crutch and knee walker device 100 provides a convertible ambulation mechanism that converts between a knee walker configuration 500 and a crutch configuration 502 through a single folding or expanding articulation that requires no tools or skillset. The combination crutch and knee walker device 100, hereafter "device 100", includes a pair of first support bars 102*a*, 102*b* that form the primary lever of support for both the crutch and knee walker configurations 500, 502. A pair of second support bars 200*a*, 200*b* pivotally joins the pair of first support bars 102*a-b* at a hinged junction 110, generally three-quarters down from the top of the pair of first support bars 102*a-b*. The support bars 102*a-b*, 200*a-b* hingedly articulate about the hinged junction 110 to convert between the knee walker and crutch configurations 500, 502.

In some embodiments, a panel 300 hingedly joins a panel end 204 of the second support bars 200*a-b*, serving as a supportive platform for an upper body, such as the arm or the knee, depending on the crutch or knee walker configuration. Further, the mobility function, such as at least one roller 112, may be selectively restricted or freed for rotation depending on the selected configuration of the device. A plurality of wheels 206*a*, 206*b* at a second mobile end of the second support bars 200*a-b* are lowered and raised to the ground surface in conjunction with the hinged articulation of the support bars 102*a-b*, 200*a-b* to enable rolling in the knee walker configuration 500, or disengagement with the ground surface in the crutch configuration 502.

Figure 1B:
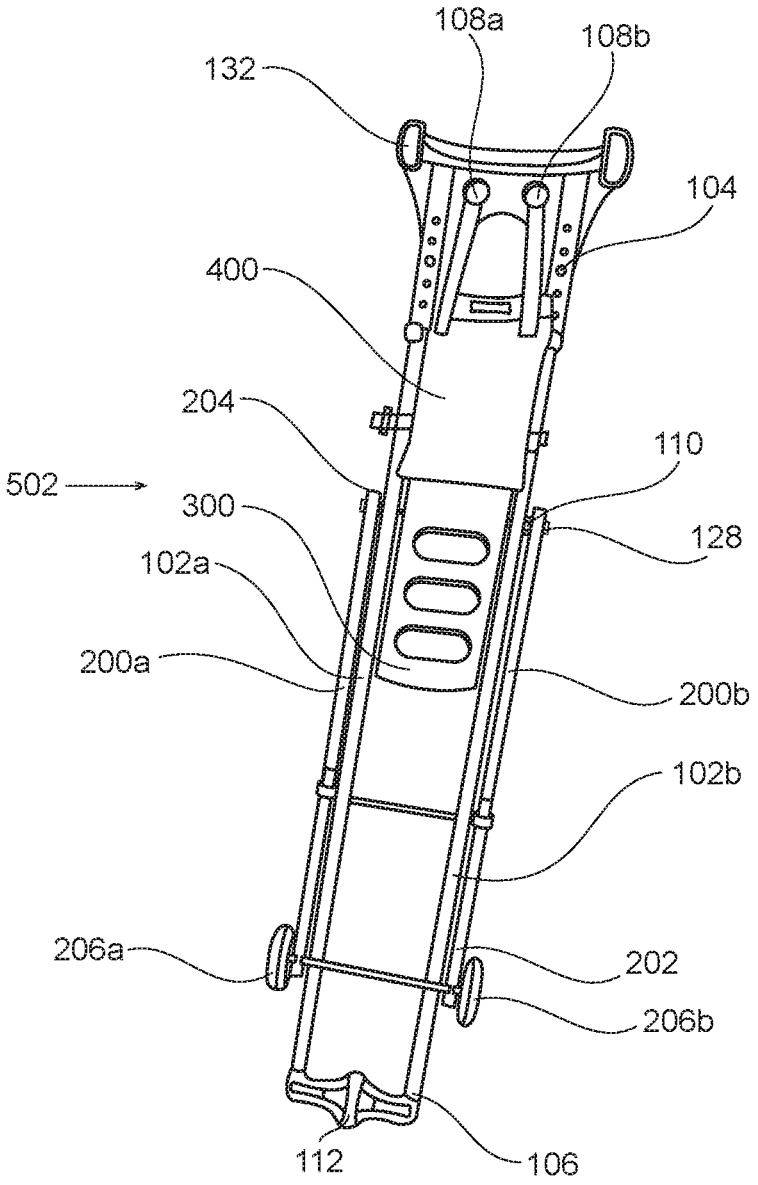
Figure 2:
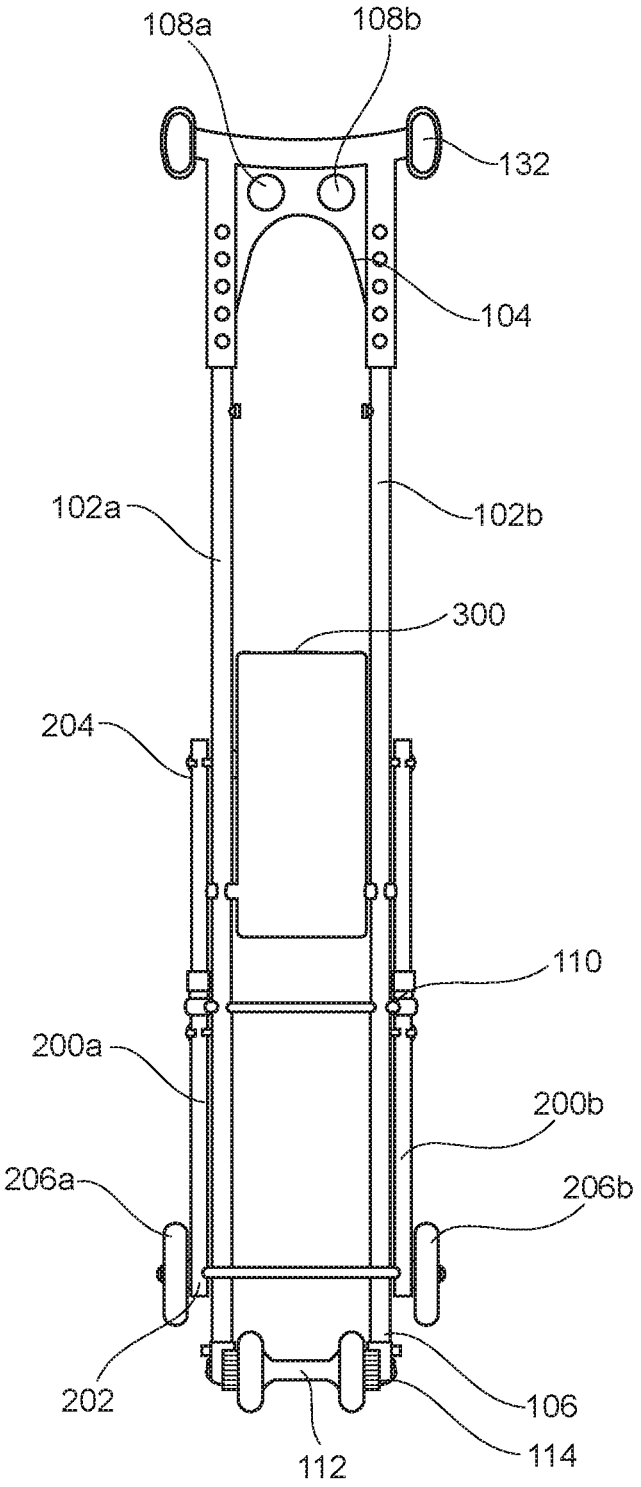
FIG. 2 illustrates an elevated side view of the crutch from the device of FIG. 1B and the relationship between an exemplary first support bar and a second support bar, in accordance with an embodiment of the present invention.

FIGS. 1A and 1B illustrate the device 100 in both possible configurations. FIG. 1A shows the knee walker configuration, and FIG. 1B shows the crutch configuration. FIG. 2 also illustrates an elevated side view of the crutch configuration and the relationship between the first and second support bars 102*a*, 102*b*, 200*a*, 200*b*. The device 100 converts between a knee walker and a crutch through a single folding or expanding articulation that requires no special tools or skillset.

Those skilled in the art will recognize that crutches are a common ambulation aid that can be used as a single side aid or dual side, one on each side of a patient with a leg injury. Crutches can also be used ascending or descending stairs, commonly using only one crutch while holding the handrail to be easier and safer. However, when crutches are used on rather flat surfaces, movement is rather slow compared to normal two-leg walking.

It is also known that knee walkers provide another ambulation aid that utilizes a soft lower platform for the user to place the knee. The knee walker includes front handles to hold while pushing along with the good leg, like a scooter. The knee walker can come in different types, some with stir able front wheels, some with 3 or 4 wheels, and some with carrying baskets. However, these knee crutches are relatively heavy compared to a common crutch and of course can't be used on stairs, only rather flat surfaces.

These devices usually have a hand brake which can be set to hold the unit from rolling then stopped or to slow down the unit while traveling. Thus, it can be advantageous to convert between a crutch and a knee walker with minimal effort or skillset. The present invention provides many of these advantages.

Looking back at FIG. 1A, the device 100 is defined by a first support bar 102*a*, 102*b* that forms the primary support for the device 100. When the device 100 is used in the crutch configuration, the first support bar 102*a*, 102*b* provides a substantial amount of the support to the user. When used in the knee walker (FIG. 2) configuration, the first support bar 102*a*, 102*b* works with a second support bar 200*a*, 200*b* and other mobility components, such as at least one wheel 206*a*, 206*b* and at least one roller 112, to support and ambulate the user. In some embodiments, the first support bar 102*a*, 102*b* may include a generally linear bar or set of dual, spaced-apart bars that extends at a sufficient length to brace the user. In some embodiments, the first support bar 102*a*, 102*b* is configured at a length for an adult to use, or made shorter for a child.

The first support bar 102*a*, 102*b* is defined by a brace end 104 for supporting the upper body of a user. The brace end 104 may include a generally curved shape to conform to the armpit when used as a crutch, or to provide a gripping surface when used in the knee walker configuration. The brace end 104 may also be padded with a knee walker handle 132 for additional comfort. This padding allows a user to more easily lean on the knee walker handle 132 when using the device 100 in the knee walker configuration.

In one embodiment, the brace end 104 may form two apertures 108*a*, 108*b*. The apertures 108*a*, 108*b* may be used to hang personal items, such as a bag 400 depicted in FIG. 1B. In one embodiment, brace end 104 is configured to fits in a user's arm pit, and is adjustable up and down via a push button spring clip mechanism 134, similar to a standard crutch known in the art. The push button spring clip mechanism 134 is operable along the brace end 104 of the first support bars 102*a-b* to enable selective height adjustability; whereby a spring pin can selectively fit into one of a series of holes to set a desired height.

Figure 6:
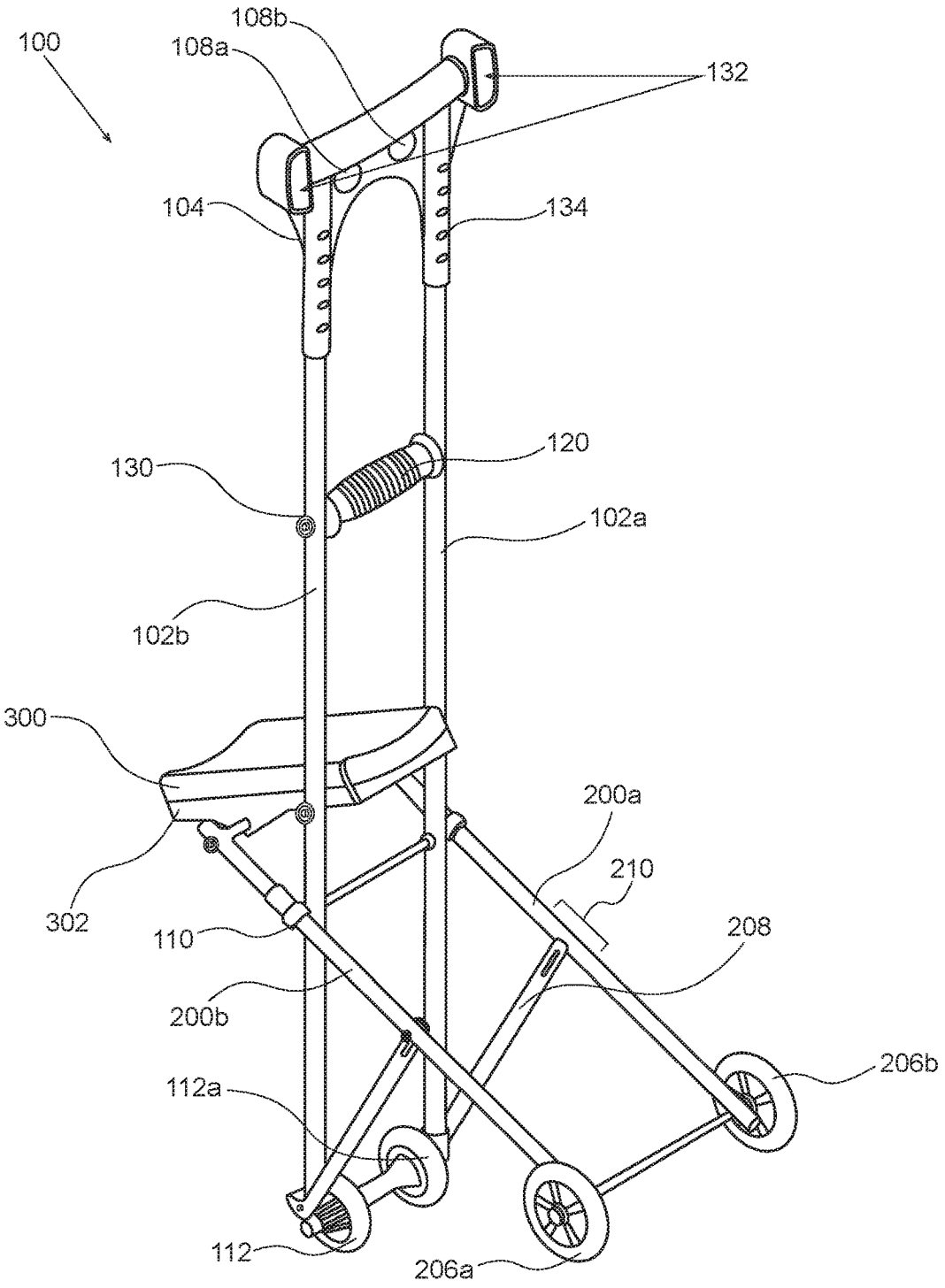
FIG. 6 illustrates an upper angle perspective view of a combination crutch and knee walker device, in accordance with an embodiment of the present invention.

In one embodiment shown in FIG. 6, a cross bar 120 may extend across the pair of first support bars 102*a*, 102*b*. The cross bar 120 provides a natural support for the arm of a user when the device 100 is in the crutch configuration. The cross bar 120 may include a rubber handle grip having texture for comfortable gripping.

At least one cross bar release clip 130 may pass through spaced-apart holes in the first support bar 102*a*, 102*b* to enable height adjustability of the cross bar 120. The cross bar release clip 130 may be spring loaded. In one embodiment, a rubber handle is positioned in various holes for adjustment via an internal shaft. That shaft is held from falling out via the cross bar release clip 130. Though, the cross bar release clip 130 not necessarily a spring clip, just a clip shaped like a spring.

Figure 4:
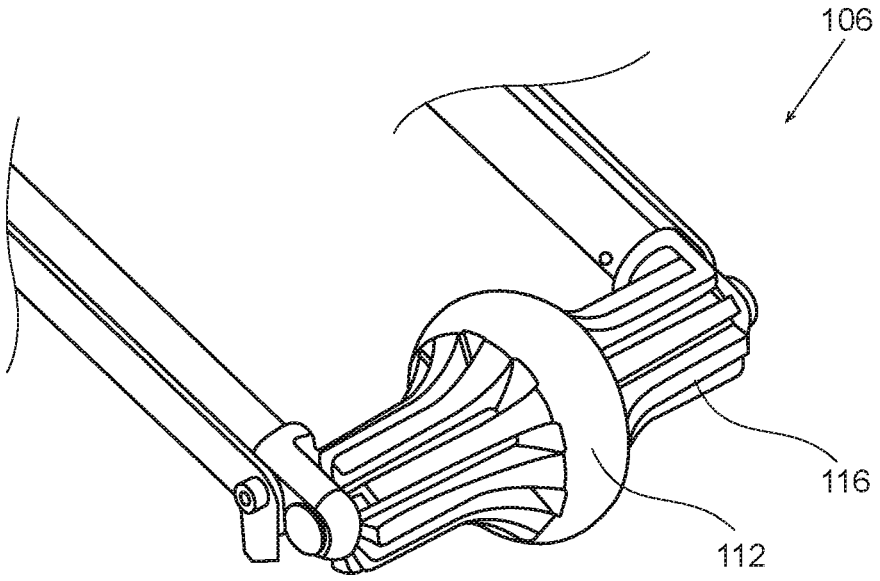
FIG. 4 illustrates a close up view of an exemplary roller on a first mobile side of the device of FIG. 1A, in accordance with an embodiment of the present invention.

As FIG. 4 illustrates, the first support bar 102*a*, 102*b* is further defined by a first mobile end 106 for enabling mobility of the knee walker. The first mobile end 106 may include at least one roller 112 that are configured to roll across a ground surface. The roller 112 may include a plurality of teeth 116. In one embodiment, one roller 112*a* is used (FIG. 1A), while in another embodiment, two roller 112*s* are used (FIG. 2). Though in other embodiments, any number of rollers may be used.

The roller 112 enables the device 100 to roll along the ground when in the knee walker configuration. Though any mobility mechanism, such as sleds, rollers, and the like may be used at the first mobile end 106. In one embodiment, the at least one roller 112 may include one center wheel or one dual wheel joined on each side, or not joined. In other embodiments, the roller 112 may include a single elongated wheel, similar to a rolling pin.

In one embodiment, the at least one roller 112 comprise a plurality of teeth 116 that are disposed radially around the circumference of the roller 112. The teeth 116 serve as gears that lock the roller 112 into the crutch configuration. In operation, the teeth 116 are engaged and disengaged, so as to allow for multiple positions that creates a link braking action using an automatic swinging motion. This is similar to a brake that restricts a wheel from rotation.

Figure 7A:
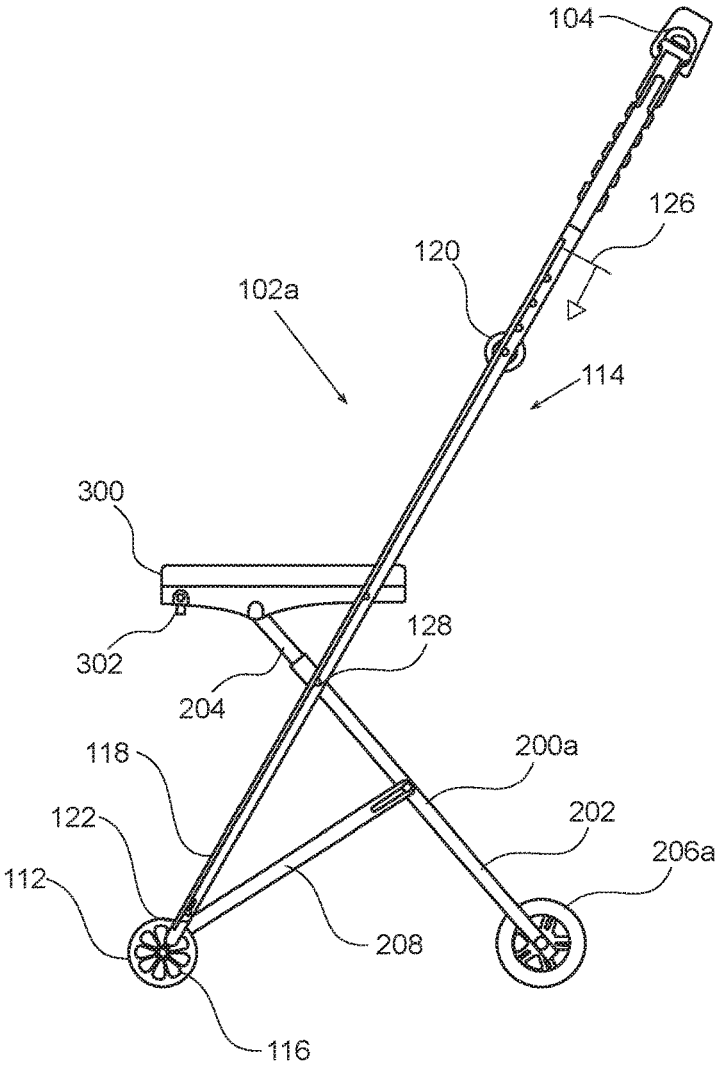
FIGS. 7A and 7B illustrates a sectioned side view of a combination crutch and knee walker device, where

As illustrated in FIG. 7A, a gear mechanism 114 may be utilized to selectively restrict and free movement of the roller 112 so as to convert between the crutch and knee walker configuration. The gear mechanism utilizes a generally elongated sliding link 118 that runs through a longitudinal axis of the first support bar 102*a*, 102*b*. The sliding link 118 may be displaced in two directions along the length of the first support bar 102*a*, 102*b* to automatically restrict or free rotation of the roller 112. The sliding link 118 includes a teeth end 122 and a lever end 124.

Figure 7B:
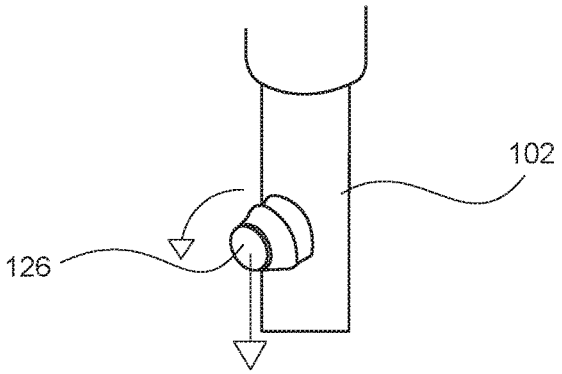

As the close up view of FIG. 7B shows, a lever 126 may be used to manipulate the sliding link 118 of the sliding link 118 in and out of engagement with the teeth 116. The lever 126 may include a cylindrical protrusion that extends from the brace end 104 of the first support bar 102*a*, 102*b*. To restrict rotation of the roller 112, the lever 126 is pushed to displace the teeth end 122 of the sliding link 118 towards the teeth 116.

In this manner, the teeth end 122 may engage the teeth 116 at the roller 112. Once the teeth end 122 and the teeth 116 at the roller 112 are engaged, the roller 112 is restricted from rotation, and in essence, becomes a bearing for walking with the crutch configuration of the device 100. Thus, the sliding link 118 that engages the teeth 116 is employed as a parking brake only, and not necessary to be used to stop the roller in the crutch position since folding link bar 208*a-b* perform this locking function automatically.

It is significant to note that this sort of manual brake is actually an optional parking brake for use when in the knee crutch configuration as it rolls. This is useful when the user desires to keep the device 100 from rolling away or to stay still while resting on it. This parking means is one possible embodiment.

In one embodiment, the teeth end 122 may include an arced member that is sized and dimensioned to slide into the teeth 116. Further, once the lever 126 displaces the sliding link 118, no added or extra motion is needed by the user, since the user is oblivious to the roller 112 being locked during the fold-up to the crutch configuration.

However, when used as a knee walker, the sliding link 118 may be displaced to disengage from the teeth 116 of the at least one roller 112. The disengagement of the rollers 112 frees the rollers 112 to rotate. In this manner, the gear mechanism 114 is configured to enable selective actuation and disengagement of the rollers 112. In one embodiment, the gear mechanism 114 is an anti-rotation locking system that engages and disengages the teeth 116 of the at least one roller 112 to restrict and free rotation.

The device 100 further includes a second support bar 200*a*, 200*b*. The second support bar 200*a*, 200*b* works in conjunction with the first support bar 102*a*, 102*b*, primarily in the knee walker configuration. In some embodiments, the second support bar 200*a*, 200*b* may include a generally linear bar or set of dual, spaced-apart bars. The second support bar 200*a*, 200*b* is disposed to cross the first support bar 102*a*, 102*b* at a hinged junction 110.

In one embodiment, the hinged junction 110 is approximately three-quarters of the way down from the brace end 104 of the first support bar 102*a*, 102*b*. In another embodiment, the hinged junction 110 comprises a primary release clip 128 that is configured to enable height adjustment of the crossbar 120. The hinged junction here is not actually adjustable. The geometries don't allow it.

In one embodiment, the hinged junction 110 may include a pin and axle that allows a smooth pivotal articulation. As discussed above, no special tools or skills are required to pivotally articulate the second support bar 200*a*, 200*b* relative to the first support bar 102*a*, 102*b* for the desired conversion between the crutch and the knee walker. In one embodiment, a locking mechanism may be used to lock the first support bar 102*a*, 102*b* and the second support bar 200*a*, 200*b* into a fixed relationship, i.e., the crutch or the knee walker configurations. In one embodiment, a spring pin maintains the first support bar 102*a*, 102*b* and the second support bar 200*a*, 200*b* into a fixed relationship, keeping them parallel and also disengaging the support bars 102*a*, 102*b*, 200*a*, 200*b* when folding out.

The second support bar 200*a*, 200*b* is defined by a panel end 204. The panel end 204 may hingedly support a panel 300. The panel 300 serves primarily as a padded, supportive surface area for the knee to rest on while the device 100 is in the knee walker configuration 500. The panel 300 hingedly joins the panel end 204 in such a manner that the panel 300 pivotally articulates simultaneously with the second support bar 200*a*, 200*b*.

In some embodiments, the panel 300 is configured to support the knee or arm of the user depending on the selection of a knee walker or a crutch. In one embodiment, the panel 300 is generally curved and resilient. The panel 300 may be padded to provide additional comfort to the arm or knee. The panel 300 may also be curved to keep the knee centered.

Figure 5:
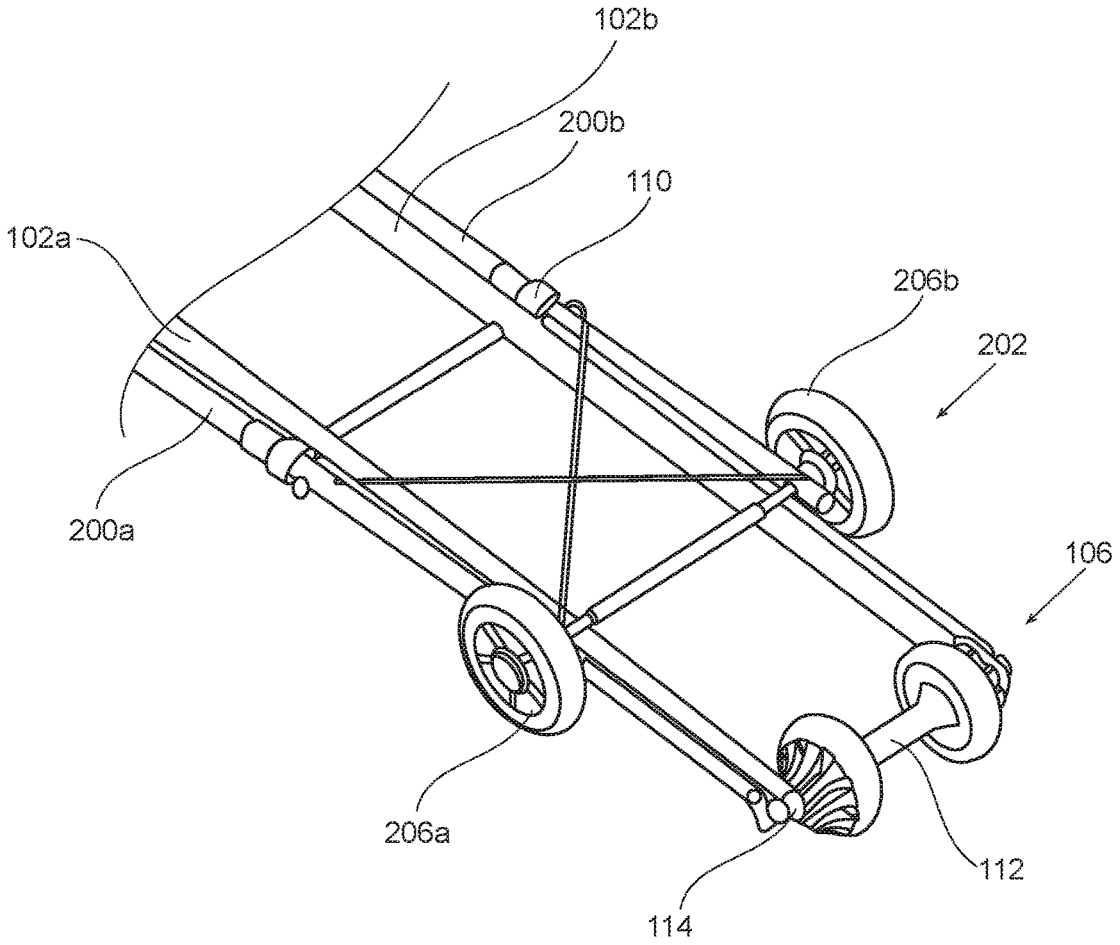
FIG. 5 illustrates a close up view of exemplary wheels on a second mobile end, and exemplary two rollers on a first mobile side of the device of FIG. 2, in accordance with an embodiment of the present invention.

As FIG. 5 shows, the second support bar 200*a-b* is further defined by a second mobile end 202 that enables mobility of the knee walker. The second mobile end 202 is actuated and disengaged by lowering or raising the wheels 206*a*, 206*b* relative to the ground surface. The wheels 206*a*, 206*b* are lowered for operation when the second support bar 200*a*, 200*b* is at an angle to the first support bar 102*a*, 102*b*, i.e., knee walker (FIG. 2).

In one embodiment, a structural reinforcement member 136 traverses the second mobile end 202 of the second support bar 200*a-b*. The structural reinforcement member 136 provides both lateral and axial structural integrity to the support bars 200*a-b*, and the device 100 as a whole. In one embodiment, the structural reinforcement member 136 may include, without limitation, a thin flat plate, a pair of metal crossbars, or a rigid panel.

The wheels 206*a*, 206*b* are raised for disengagement when the second support bar 200*a*, 200*b* is parallel to the first support bar 102*a*, 102*b*, i.e., crutch (FIG. 5). In one embodiment, the second mobile end 202 comprises two wheels 206*a*, 206*b*. Though any mechanism, such as sleds or rollers, may be used at the second mobile end 202.

Looking back at FIG. 6, the second support bar 200*a*, 200*b* includes a pair of folding link bars 208*a*, 208*b*. The folding link bar 208*a-b* extends between a central region 210 of the second support bar 200*a*, 200*b* and the first mobile end 106 of the first support bar 102*a*, 102*b*. The folding link bar 208*a-b* hingedly moves when the first and second support bars 102*a*, 102*b*, 200*a*, 200*b* pivotally articulate between the crutch configuration and the knee walker configuration. The folding link bar 208*a-b* is in communication with the panel 300. Such that both the panel and the folding link bar 208*a-b* fold and unfold in unison while pivotally articulating between the crutch and knee walker configurations.

The folding link bar 208*a-b* also slides up and down during folding. The folding link bar 208*a-b* also slide in at least one slot and swing inward to the teeth 116 to lock the roller 112 in the crutch configuration. The folding link bar 208*a-b* also maintains the relative angle and orientation of the support bars 102*a*, 102*b*, 200*a*, 200*b* due to the structural integrity provided thereby.

One unique features of the device 100 is that the link bars 208*a-b* act not only to limit the unfolding of the unit to the 120° position, but also, due to the end shapes of the link bar 208*a-b*, engagement is made to the gears to stop the roller 112 from turning automatically. Thus, the sliding link 118 that engages the teeth 116 is employed as a parking brake only, and not necessary to be used to stop the roller in the crutch position since folding link bar 208*a-b* perform this locking function automatically.

Figure 3:
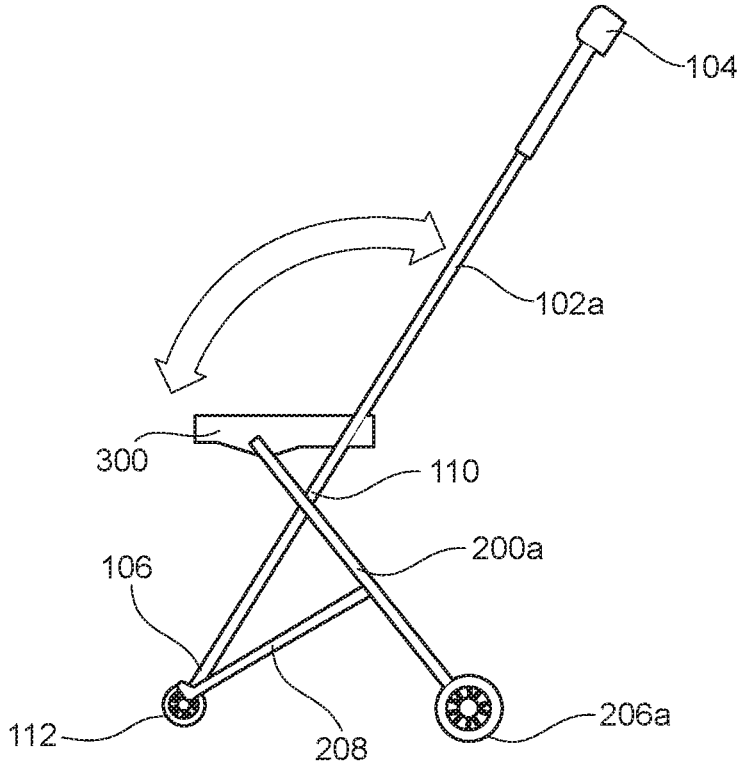
FIG. 3 illustrates an elevated side view of the knee walker from FIG. 1A and a single action folding articulation to form the crutch configuration, in accordance with an embodiment of the present invention.

As illustrated in FIG. 3, forming the crutch configuration involves pivotally articulating the second support bar 200*a*, 200*b* towards the first support bar 102*a*, 102*b* into a parallel arrangement with the panel 300. In this parallel arrangement, the panel 300 pivotally articulates with the second support bar 200*a*, 200*b*, parallel to the first support bar 102*a*, 102*b* and forms a substantial part of a brace for the arm. In one alternative embodiment, a panel extension 400 may join with the two apertures 108*a*, 108*b* at the brace end 104 of the first support bar 102*a*, 102*b*. The apertures 108*a*, 108*b* may be used to hang personal items, such as a bag 400 depicted in FIG. 1B.

Also in the parallel arrangement, the wheels 206*a*, 206*b* at the second mobile end 202 disengage from the ground surface, and the gear mechanism 114 locks the roller 112 at the first mobile end 106 to form a static, stable base for supporting the weight of the user. Also, the hinged junction 110 may be locked into this crutch configuration as the folding link bar 208*a-b* engages the teeth 116.

As discussed above, the device 100 comprises a panel 300 that hingedly joins a 204 panel end of the second support bar 200*a*, 200*b*. The panel 300 serves as a supportive platform for the arm or knee, depending on the selected ambulation aid. In the crutch configuration, the panel 300 extends parallel to the support bars 102*a*, 102*b*, 200*a*, 200*b* to support the length of the arm laterally. The panel 300 as shown in FIG. 1A, enables the apertures a clever means for the user to place the hand in the most appropriate opening. So in that sense the panel 300 is also a hand (arm) rest.

In the knee walker configuration, the panel 300 folds in at about 120° to the crossed support bars 102*a*, 102*b*, 200*a*, 200*b* to support the knee, and the weight of the user. Thus, in the flat configuration of the panel 300, shown in FIG. 2 is designed to support the knee, not the arm.

Figure 8A:
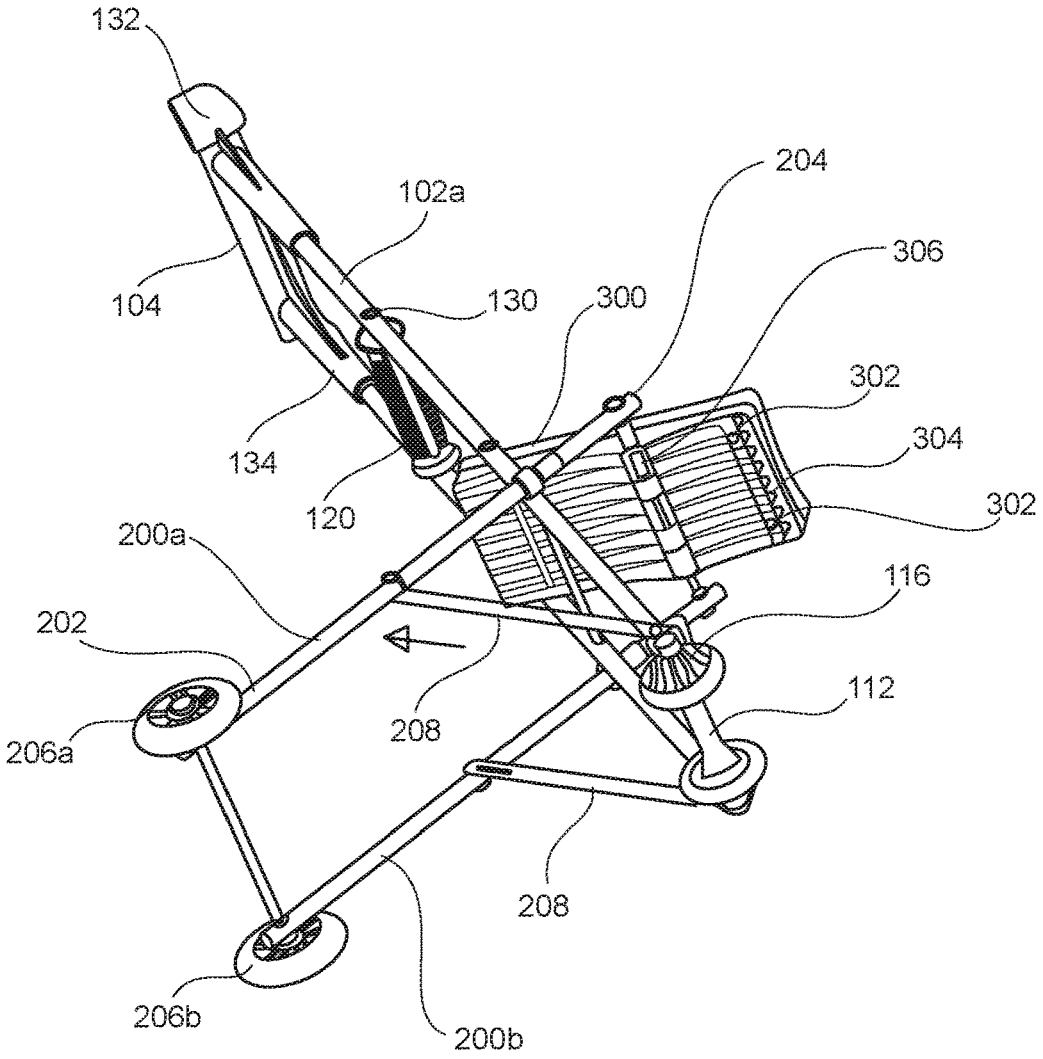
FIGS. 8A and 8B illustrates a lower angle perspective view of a combination crutch and knee walker device, where
Figure 8B:
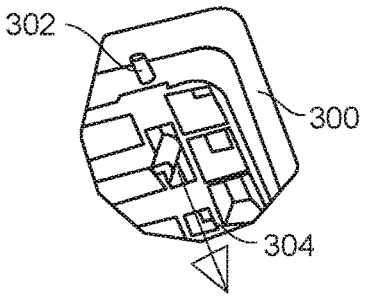

As FIGS. 8A and 8B illustrate, a channel 304 transversely crosses a bottom surface of the panel 300. The channel is configured to receive at least one panel release pin 302. The panel release pin 302 is displaced along the length of the channel 304 to regulate folding of the panel 300. In one embodiment, the panel release pin 302 may restrict folding of the panel 300, so as to maintain the device 100 in the knee walker configuration. This is possible because the panel release pin 302 may be spring loaded, so as to create an outward bias that restricts folding of the panel 300 into the knee walker configuration.

In one embodiment, two panel release pins on opposite sides of the channel 304 are displaced towards each other to release the panel 300 for folding into the crutch configuration. Thus, when a force is applied inwardly to the panel release pin 302, the panel 300 is freed to fold into the crutch configuration. In this manner, the panel release pin 302 is significant in dictating the configuration of the device 100.

In operation of the device 100, forming the knee walker configuration involves pivotally articulating the first support bar 102*a-b* away from the second support bar 200*a-b* and thereby forming a crossing arrangement between support bars 102*a-b*, 200*a-b*. In this angled configuration, the panel 300 is pivotally articulated at about 120° relative to the second support bar 200*a-b*.

This enables the panel 300 to form a supportive platform for the knee in the knee walker configuration. The angled disposition that forms between the support bars 102*a-b*, 200*a-b* extends the wheels 206*a*, 206*b* at the second mobile end 202 to engage the ground surface. Also, the pivoting links 208*a* and 208*b* and gear mechanism 114 disengages from the roller 112 to enable their free rotation. Thereby both the wheels 206*a*, 206*b* and the roller 112 are operable to enable mobility to the user in the knee walker configuration.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A combination crutch and knee walker device, the device comprising:

a pair of first support bars defined by a first mobile end and a brace end;

at least one roller disposed at the first mobile end of the pair of support bars, the at least one roller having a plurality of teeth disposed in a radial arrangement;

a gear mechanism configured to enable selective engagement and disengagement with the plurality of teeth of the at least one roller, whereby the gear mechanism selectively restricts rotation of the at least one roller or enables free rotation of the at least one roller, the gear mechanism comprising a sliding link defined by a teeth end and a lever end, the sliding link configured to extend along the length of the pair of first support bars;

a lever configured to operatively connect to the lever end of the sliding link, the lever further configured to enable displacement of the teeth end of the sliding link in and out of engagement with the plurality of teeth, whereby engagement of the teeth end with the plurality of teeth restricts rotation of the at least one roller, whereby disengagement of the teeth end from the plurality of teeth enables free rotation of the at least one roller;

a crossbar configured to traverse the pair of first support bars;

a pair of second support bars defined by a second mobile end and a panel end, the pair of second support bars configured to pivotally engage the pair of first support bars at a hinged junction, whereby the pair of second support bars are configured to pivotally articulate parallel to, or at an angle relative to the pair of first support bars;

a plurality of wheels disposed at the second mobile end of the pair of second support bars, the plurality of wheels configured to enable mobility of the device;

a pair of folding link bars disposed to extend between a generally central region of the pair of second support bars and the first mobile end of the pair of first support bars, the pair of folding link bars configured to help maintain structural integrity and relative positioning of the pairs of first and second support bars, the pair of folding link bars further configured to be in hinged communication with the pairs of first and second support bars;

a panel configured to hingedly join with the panel end of the pair of second support bars, the panel configured to pivotally articulate in conjunction with the pair of second support bars, the panel comprising an upper surface and a bottom surface defined by a channel, whereby a crutch configuration forms during a parallel disposition of the panel relative to the pair of first and second support bars, and a parallel disposition of the second support bar to the first support bar, whereby a knee walker configuration forms when the panel is disposed at an angle relative to the pair of second support bars, and the pair of second support bars are disposed at an angle relative to the pair of first support bars; and a panel release pin configured to pass through the channel in the bottom surface of the panel, the panel release pin configured to be spring loaded, whereby the panel release pin creates an outward bias that restricts folding of the panel, whereby when an inward force is applied to the panel release pin, the panel folds freely.

2. The device of claim 1, further comprising a panel axle extending between the pair of second support bars, the panel axle being proximal to the panel end.

3. The device of claim 2, wherein the panel pivots about the panel axle.

4. The device of claim 1, wherein the brace end of the pair of first support bars has a generally arced shape.

5. The device of claim 1, wherein the brace end of the pair of first support bars forms two apertures.

6. The device of claim 5, wherein the two apertures are configured to receive a bag.

7. The device of claim 1, further comprising a push button spring clip mechanism operable to enable height adjustment of the pair of first support bars.

8. The device of claim 1, wherein the at least one roller is defined by the plurality of teeth.

9. The device of claim 1, wherein the gear mechanism is configured to selectively lock the second support bar either parallel or at an angle relative to the first support bar.

10. The device of claim 1, wherein the gear mechanism inhibits rotation of the at least one roller.

11. The device of claim 1, wherein the teeth end of the sliding link forms an arc shape that is configured to slide between the plurality of teeth.

12. The device of claim 1, wherein a terminus of the pair of folding link bars forms an arc shape that is configured to slide between the plurality of teeth.

13. The device of claim 1, wherein the at least one roller may include at least one of the following: a single center wheel, a dual wheel joined on two sides, a dual wheel, and an elongated wheel.

14. The device of claim 1, wherein the plurality of teeth comprises two spaced-apart wheels.

15. The device of claim 1, wherein the panel is generally curved and resilient.

16. The device of claim 1, wherein the pair of first support bars and the pair of second support bars are fabricated from a medical grade material.

17. The device of claim 1, wherein the crutch end is height adjustable through a spring clip.

18. A combination crutch and knee walker device for converting between a crutch configuration and a knee walker configuration, the device consisting of:

a pair of first support bars defined by a first mobile end and a brace end, the brace end forming two apertures;

at least one roller disposed at the first mobile end of the pair of support bars, the at least one roller having a plurality of teeth disposed in a radial arrangement;

a gear mechanism configured to enable selective engagement and disengagement with the plurality of teeth of the at least one roller, whereby the gear mechanism selectively restricts rotation of the at least one roller or enables free rotation of the at least one roller, the gear mechanism comprising a sliding link defined by a teeth end and a lever end, the sliding link configured to extend along the length of the pair of first support bars;

a lever configured to operatively connect to the lever end of the sliding link, the lever further configured to enable displacement of the teeth end of the sliding link in and out of engagement with the plurality of teeth, whereby engagement of the teeth end with the plurality of teeth restricts rotation of the at least one roller, whereby disengagement of the teeth end from the plurality of teeth enables free rotation of the at least one roller;

crossbar configured to traverse the pair of first support bars;

a pair of second support bars defined by a second mobile end and a panel end, the pair of second support bars configured to pivotally engage the pair of first support bars at a hinged junction, whereby the pair of second support bars are configured to pivotally articulate parallel to, or at an angle relative to the pair of first support bars;

a structural reinforcement member traversing the second mobile end of the second support bar;

a plurality of wheels disposed at the second mobile end of the pair of second support bars, the plurality of wheels configured to enable mobility of the device;

a pair of folding link bars disposed to extend between a generally central region of the pair of second support bars and the first mobile end of the pair of first support bars, the pair of folding link bars configured to help maintain structural integrity and relative positioning of the pairs of first and second support bars, the pair of folding link bars further configured to be in hinged communication with the pairs of first and second support bars;

a panel configured to hingedly join with the panel end of the pair of second support bars, the panel configured to pivotally articulate in conjunction with the pair of second support bars, the panel comprising an upper surface and a bottom surface defined by a channel, whereby a crutch configuration forms during a parallel disposition of the panel relative to the pair of first and second support bars, and a parallel disposition of the pair of second support bars to the pair of first support bars, whereby a knee walker configuration forms when the panel is angled relative to the pair of second support bars, and the pair of second support bars are angled relative to the pair of first support bars; and a panel release pin configured to pass through the channel in the bottom surface of the panel, the panel release pin configured to be spring loaded, whereby the panel release pin creates an outward bias that restricts folding of the panel, whereby when an inward force is applied to the panel release pin, the panel folds freely.

* * * * *